US010113558B2

(12) United States Patent
Chrabascz et al.

(10) Patent No.: US 10,113,558 B2
(45) Date of Patent: Oct. 30, 2018

(54) FAN AND COMPRESSOR HOUSING

(71) Applicant: Hamilton Sundstrand Corporation, Windsor Locks, CT (US)

(72) Inventors: Eric Chrabascz, Longmeadow, MA (US); Seth E. Rosen, Middletown, CT (US)

(73) Assignee: Hamilton Sunstrand Corporation, Windsor Lock, CT (US)

( * ) Notice: Subject to any disclaimer, the term of this patent is extended or adjusted under 35 U.S.C. 154(b) by 336 days.

(21) Appl. No.: 14/989,191

(22) Filed: Jan. 6, 2016

(65) Prior Publication Data

US 2017/0191497 A1 Jul. 6, 2017

(51) Int. Cl.

| | |
|---|---|
| ***F04D 29/52*** | (2006.01) |
| ***F04D 25/02*** | (2006.01) |
| ***F04D 29/64*** | (2006.01) |

(52) U.S. Cl.

CPC ..... *F04D 29/522* (2013.01); *F04D 25/024* (2013.01); *F04D 29/644* (2013.01)

(58) Field of Classification Search

CPC ..... F04D 29/522; F04D 25/024; F04D 29/644

See application file for complete search history.

(56) References Cited

U.S. PATENT DOCUMENTS 6,151,909 A * 11/2000 Carter ..... B64D 13/08 62/402

2014/0199167 A1 7/2014 Beers et al.

* cited by examiner

*Primary Examiner* — Richard Edgar

(74) *Attorney, Agent, or Firm* — Kinney & Lange, P.A.

(57) ABSTRACT

A fan housing for an air cycle machine includes a fan exit flow passage and a ring disposed around a center axis of the fan housing and disposed around the fan exit flow passage. The ring includes a first end disposed axially opposite a second end and a guide surface facing radially inward relative the center axis and formed between the first end and the second end. The ring also includes a shelf disposed radially inward from the guide surface. The shelf includes a stop surface extending radially and disposed axially between the second end and the guide surface. The shelf also includes a shelf surface facing radially outward relative the center axis and extending axially between the first end and the stop surface.

13 Claims, 3 Drawing Sheets

FAN AND COMPRESSOR HOUSING

BACKGROUND

The present invention relates to Air Cycle Machines (ACMs) used in aircraft environmental control systems, and more specifically to a fan and compressor housing for use in ACMs.

Conventional aircraft environmental control systems incorporate an ACM for cooling and dehumidifying air supplied to an aircraft cabin. ACMs generally include a compressor section to compress air. The compressed air is discharged to a downstream heat exchanger and further routed to a turbine. The turbine extracts energy from the expanded air to drive the compressor. The air output from the turbine is generally utilized as an air supply for a vehicle, such as the cabin of an aircraft. ACMs can be used to achieve a desired pressure, temperature, and humidity in the air that is transferred to the environmental control system of the aircraft.

ACMs often have a three-wheel or four-wheel configuration. In a three-wheel ACM, a turbine drives both a compressor and a fan which rotate on a common shaft. In a four-wheel ACM, two turbine sections drive a compressor and a fan on a common shaft. In any configuration, a first airflow can be directed into the compressor section and a second airflow can be directed into the fan section. After the first airflow is compressed by the compressor, the first airflow can be directed to a heat exchanger to cool the first airflow to a desired temperature before the first airflow travels to the turbine or turbines. The second airflow is directed by the fan section towards the heat exchanger to cool the first airflow.

The fan section includes a row of fan blades that rotate to draw the second airflow into the fan section and onto the heat exchanger. In the event that one of the fan blades of the fan section should break free of the common shaft during operation, the severed fan blade could impact and damage the housing of the fan section. In traditional ACMs, the housing surrounding the fan section is often integral with the housing of the compressor section, forming a single component with a complex geometry that is expensive to repair or replace.

SUMMARY

In one aspect of the invention, a fan housing for an air cycle machine includes an outer ring disposed around a center axis of the fan housing, and at least one strut extending radially inward from the outer ring. An inner ring is disposed radially inward from the outer ring and is connected to the at least one strut opposite the outer ring. The inner ring includes a first end disposed axially opposite a second end and a guide surface facing radially inward relative the center axis and formed between the first end and the second end. The inner ring also includes a shelf disposed radially inward from the guide surface. The shelf includes a stop surface extending radially and disposed axially between the second end and the guide surface. The shelf also includes a shelf surface facing radially outward relative the center axis and extending axially between the first end and the stop surface.

In another aspect of the invention, a fan housing for an air cycle machine includes a fan exit flow passage and a ring disposed around a center axis of the fan housing and disposed around the fan exit flow passage. The ring includes a first end disposed axially opposite a second end and a guide surface facing radially inward relative the center axis and formed between the first end and the second end. The ring also includes a shelf disposed radially inward from the guide surface. The shelf includes a stop surface extending radially and disposed axially between the second end and the guide surface. The shelf also includes a shelf surface facing radially outward relative the center axis and extending axially between the first end and the stop surface.

Persons of ordinary skill in the art will recognize that other aspects and embodiments of the present invention are possible in view of the entirety of the present disclosure, including the accompanying figures.

Figure 1:
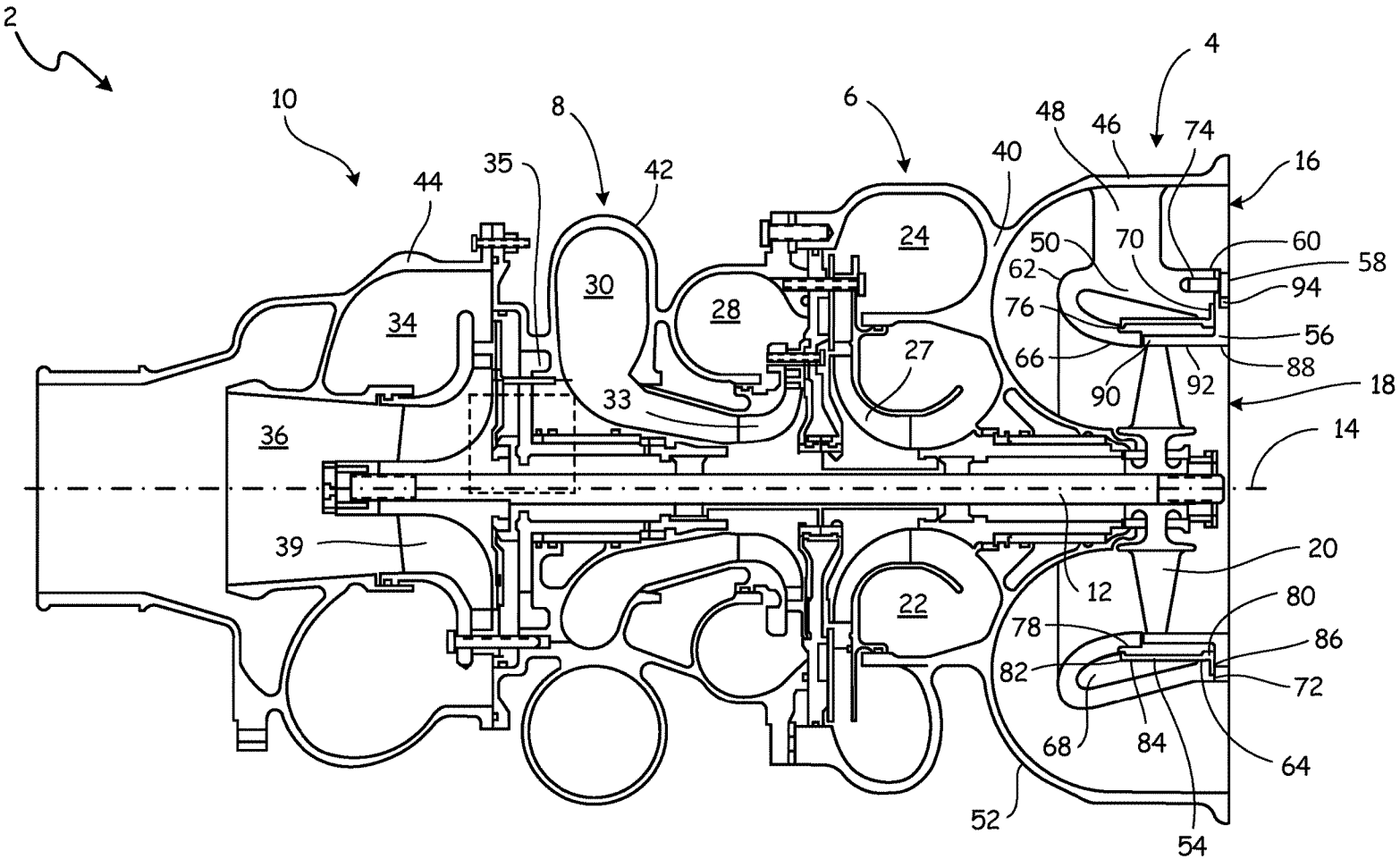
FIG. 1 is a cross-sectional view of an embodiment of an air cycle machine.

While the above-identified drawing figures set forth one or more embodiments of the invention, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings. Like reference numerals identify similar structural elements.

DETAILED DESCRIPTION

The invention relates to a fan and compressor housing for an air cycle machine (ACM) that includes a detachable fan shroud and containment ring. In the event that a fan blade of the ACM should break and impact the fan and compressor housing, the fan shroud and the containment ring will absorb the majority of the impact of the fan blade, thereby preserving the rest of the fan and compressor housing and reducing the cost to repair the ACM. The fan and compressor housing includes attachment features with dimensions and dimensional ratios that are selected to maintain fit between the containment ring, the fan shroud, and the rest of the fan and compressor housing and to improve the energy-dissipating performance of the containment ring. Some exemplary embodiments of the piston are discussed below with reference to the figures.

Figure 2:
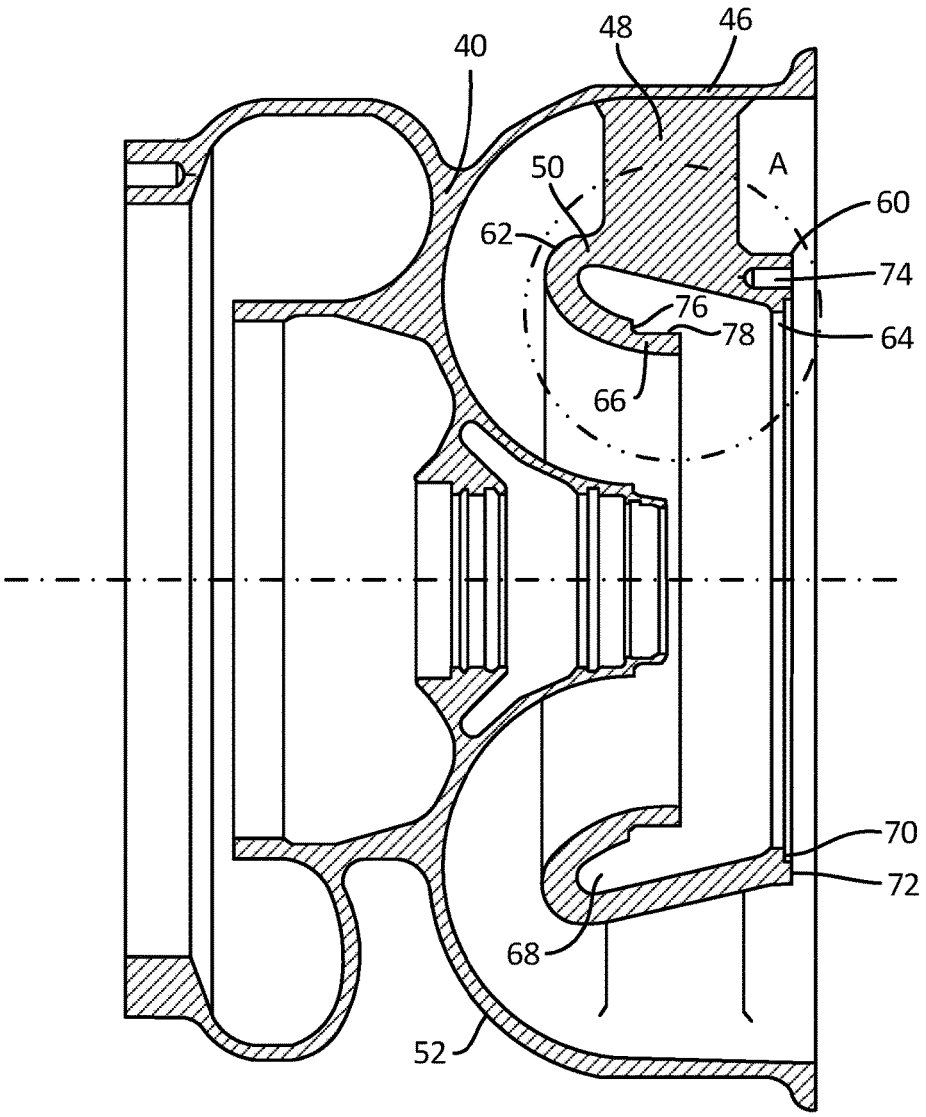
FIG. 2 is a cross-sectional view of a fan and compressor housing from the air cycle machine of FIG. 1.
Figure 3:
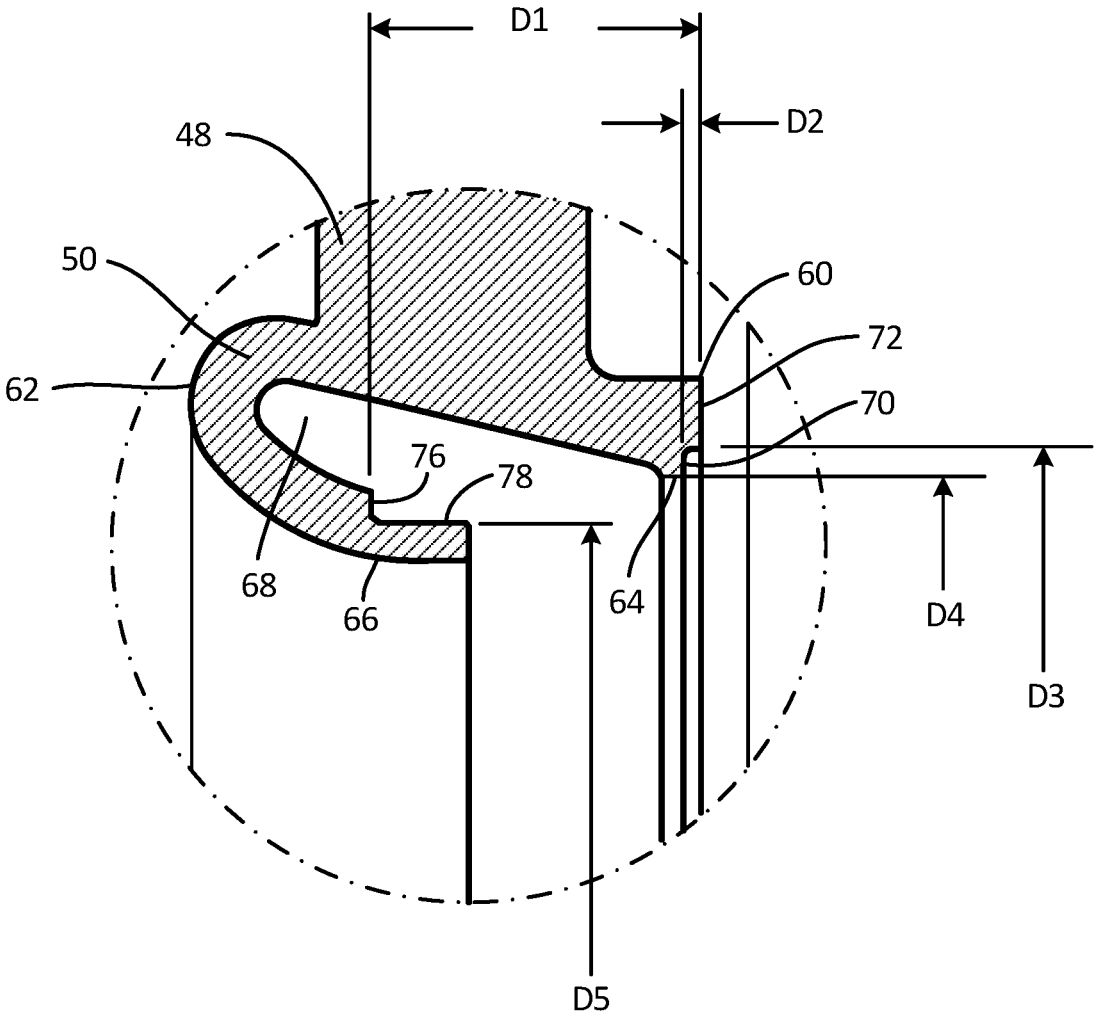
FIG. 3 is an enlarged cross-sectional view of a ring of the fan and compressor housing taken from circle A in FIG. 2.

FIGS. 1-3 will be discussed concurrently. FIG. 1 is a cross-sectional view of ACM 2. ACM 2 is a four-wheel ACM, containing fan section 4, compressor section 6, first turbine section 8, and second turbine section 10, which are all connected to shaft 12 for common rotation about center axis 14. It should be noted that ACM 2 is shown and described merely by way of example and not limitation. Numerous other ACM configurations are possible in further embodiments, such as for three-wheel ACMs. FIG. 2 is a cross-sectional view of fan and compressor housing 40 of ACM 2, and FIG. 3 is an enlarged cross-sectional view of inner ring 50 of fan and compressor housing 40 taken from circle A in FIG. 2.

When a first working fluid passes through ACM 2, the first working fluid is first compressed in compressor section 6, and then expanded in first turbine section 8 and second turbine section 10. Often, the first working fluid is cooled in a heat exchanger (not shown) through which the first working fluid is routed as the first working fluid passes between compressor section 6 and first turbine section 8. First turbine section 8 and second turbine section 10 extract energy from the first working fluid, turning shaft 12 about center axis 14. Meanwhile, a second working fluid is routed through the same heat exchanger by fan section 4. For example, the first working fluid can be routed from a bleed valve of a gas turbine engine through compressor section 6, to a heat exchanger, to first turbine section 8, then to second turbine section 10, and then to the environmental control system of an aircraft. The second working fluid can be ram air that is pulled by fan section 4 through the same heat exchanger to cool the first working fluid to a desired temperature before routing of the first working fluid to the turbine sections 8 and 10. By compressing, temperature treating, and expanding the working fluid, the output provided at the second turbine 10 can be adjusted to a desired temperature, pressure, and/or relative humidity.

Fan section 4 includes fan inlet 16 and fan outlet 18. Fan inlet 16 is an opening in ACM 2 that receives the second working fluid from another source, such as a ram air scoop. Fan outlet 18 allows the second working fluid to escape fan section 4. Fan blades 20 can be used to draw the second working fluid into fan section 4.

Compressor section 6 includes compressor inlet 22, compressor outlet 24, and compressor blades 27. Compressor inlet 22 is a duct defining an aperture through which the first working fluid to be compressed is received from another source. Compressor inlet 22 directs the first working fluid from compressor inlet 22 to compressor blades 27 where the first working fluid is compressed before entering compressor outlet 24. Compressor outlet 24 allows the first working fluid to be routed to other systems after the first working fluid has been compressed.

First turbine section 8 includes first stage turbine inlet 28, first stage turbine outlet 30, and first turbine blades 33. First stage turbine inlet 28 is a duct defining an aperture through which the first working fluid passes prior to expansion in first turbine section 8. First stage turbine outlet 30 is a duct defining an aperture through which the first working fluid (which has expanded) departs first turbine section 8. First stage turbine blades 33 are disposed in the flow path between first stage turbine inlet 28 and outlet 30 and extract energy from the first working fluid passing therethrough, driving the rotation of first turbine section 8 and attached components, including shaft 12, fan section 4, and compressor section 6.

Second turbine section 10 includes second stage turbine inlet 34, second stage turbine outlet 36, and second stage turbine blades 39. Second stage turbine inlet 34 is a duct defining an aperture through which the first working fluid passes prior to expansion in second turbine section 10. Second stage turbine outlet 36 is a duct defining an aperture through which the first working fluid (which has expanded) departs second turbine section 10. Second stage turbine blades 39 are disposed in the flow path between second stage turbine inlet 34 and second stage turbine outlet 36 and extract energy from working fluid passing therethrough, driving the rotation of second turbine section 10 and attached components, including shaft 12, fan section 4, and compressor section 6. The first working fluid passes from second stage turbine inlet 34 to cavity 35, where the first working fluid is incident upon second stage turbine blades 39. The first working fluid can then pass across vanes or nozzles that help guide and straighten the flow of the first working fluid for optimum efficiency. The flow of the first working fluid causes turbine blades 39 to rotate and turn shaft 12.

Shaft 12 can be a rod, such as a titanium tie-rod, used to connect other components of ACM 2. Center axis 14 is an axis with respect to which other components can be arranged. Shaft 12 can mechanically connect fan section 4 to compressor section 6. Fan section 4 and compressor section 6 can also include fan and compressor housing 40. Fan and compressor housing 40 can enclose both the moving parts and air paths through fan section 4 and compressor section 6. The size and geometry of fan and compressor housing 40 define the flow of air through ACM 2. Fan and compressor housing 40 can be sized to coordinate with adjacent housing sections, such as first turbine housing 42 and second turbine housing 44.

As shown in FIG. 1, fan and compressor housing 40 can include outer ring 46, struts 48, inner ring 50, curved wall 52, containment ring 54, shroud 56, and fasteners 58. Inner ring 50 can include first end 60, second end 62, guide surface 64, shelf 66, cavity 68, recess 70, mounting surface 72, and mounting holes 74. Shelf 66 of inner ring 50 can include stop surface 76 and shelf surface 78. Containment ring 54 can include first end 80, second end 82, tubular body 84, and flange 86. Shroud 56 can include first end 88, second end 90, tubular body 92, and mounting flange 94.

Outer ring 46 is disposed around center axis 14. Center axis 14 can be the center axis for both ACM 2 and fan and compressor housing 40. Inner ring 50 is disposed radially inward from outer ring 46 and struts 48 are circumferentially spaced from one another and can extend radially inward from outer ring 46 to inner ring 50. Struts 48 are connected to both inner ring 50 and outer ring 46 and can space outer ring 46 radially opposite inner ring 50 to form fan inlet 16. Inner ring 50 forms fan outlet 18 and is disposed around fan blades 20. Curved wall 52 can be connected to outer ring 46 and can curve 180 degrees towards fan blades 20. Curved wall 52, along with inner ring 50, forms a curved flow passage between fan inlet 16 and fan outlet 18, thereby allowing the working fluid entering fan inlet 16 to turn 180 degrees before exiting fan section 4 through fan outlet 18. As shown in FIGS. 1-3, outer ring 46, struts 48, inner ring 50, and curved wall 52 can all be integral and can be formed as a unitary part through a casting process. Outer ring 46, struts 48, inner ring 50, and curved wall 52 can be formed from aluminum or an aluminum alloy, such as 6061 aluminum alloy, or any other material that can be readily shaped into the geometry of fan and compressor housing 40 while meeting the operating conditions of ACM 2.

Containment ring 54 and shroud 56 can be disposed radially inward of inner ring 50 and disposed radially outward of fan blades 20. Should one of fan blades 20 disconnect from shaft 12 during operation of ACM 2, also known as a "blade out event," containment ring 54 and shroud 15 are configured to absorb the forces from the impact of the disconnected fan blade 20, thereby protecting the rest of fan and compressor housing 40 from damage. As shown in FIG. 1, containment ring 54 can include tubular body 84 extending axially between first end 80 of containment ring 54 and second end 82 of containment ring 54. Flange 86 of containment ring 54 can extend radially outward from tubular body 84 at first end 80 of containment ring 54. Containment ring 54 can be formed from steel, such as 4130 steel, or any other material suitable to contain impacts from fan blades 20. Shroud 56 can include tubular body 92 extending between first end 88 of shroud 56 and second end 90 of shroud 56. Shroud 56 can also include mounting flange 94 extending radially outward from tubular body 92 of shroud 56 at first end 88 of shroud 56. Shroud 56 can be formed from aluminum or an aluminum alloy, such as 6061 aluminum alloy, or any other material that can be shaped into the geometry of shroud 56 while meeting the operating conditions of ACM 2.

Containment ring 54 and shroud 56 are releasably connected to inner ring 50 so that containment ring 54 and shroud 56 can be quickly disconnected from inner ring 50 and replaced after a blade out event. Inner ring 50 includes guide surface 64, shelf 66, recess 70, mounting surface 72, and mounting holes 74 to aid in releasably connecting containment ring 54 and shroud 56 to inner ring 50. As shown in FIGS. 1-3, first end 60 of inner ring 50 is disposed axially opposite second end 62 of inner ring 50. Guide surface 64 can be formed between first end 60 and second end 62 of inner ring 50 and faces radially inward relative center axis 14. Shelf 66 can be disposed radially inward from guide surface 64. Stop surface 76 of shelf 66 can extend radially and be disposed axially between second end 62 of inner ring 50 and guide surface 64. Shelf surface 78 of shelf 66 can extend axially between first end 60 of inner ring 50 and stop surface 76 of shelf 66. As shown in FIGS. 1-3, shelf surface 78 faces radially outward relative center axis 14.

Recess 70 is formed on first end 60 of inner ring 50. Recess 70 can be a counterbore that extends axially between first end 60 and guide surface 64, and extends radially inward to guide surface 64. Mounting surface 72 can also be disposed at first end 60 of inner ring 50 and can extend radially outward from recess 70. Mounting holes 74 can be formed in mounting surface 72 and first end 60 of inner ring 50, and can be spaced circumferentially from one another on mounting surface 72.

When assembling containment ring 54 and shroud 56 onto inner ring 50, second end 82 of tubular body 84 of containment ring 54 is positioned so that second end 82 of tubular body 84 of containment ring 54 can extend onto shelf surface 78 of shelf 66. Second end 82 of tubular body 84 can abut against stop surface 76 of shelf 66. With second end 82 of tubular body 84 of containment ring 54 positioned onto shelf 66, tubular body 84 of containment ring 54 can be positioned against guide surface 64, and flange 86 of containment ring 54 can extend into recess 70 of inner ring 50 proximate first end 60 of inner ring 50.

With containment ring 54 positioned onto inner ring 50, shroud 56 can then be attached onto inner ring 50 to secure containment ring 54. When assembled onto inner ring 50, second end 90 of tubular body 92 of shroud 56 can be disposed radially inward from tubular body 84 of containment ring 54 and radially inward of shelf surface 78 of shelf 66. Mounting flange 94 can be positioned against mounting surface 72 of inner ring 50 so that mounting flange 94 covers recess 70 and flange 86 of containment ring 54. With mounting flange 94 of shroud 56 placed against mounting surface 72, fasteners 58 can be inserted through holes in mounting flange 94 and into mounting holes 74 of inner ring 50 to secure shroud 56 and containment ring 54 to inner ring 50. Fasteners 58 can be threaded fasteners, such as screws or bolts. With flange 86 of containment ring 54 disposed in recess 70, second end 82 of containment ring 54 disposed against stop surface 76 of shelf 66, and mounting flange 94 of shroud 56 connected to mounting surface 72 of inner ring 50, containment ring 54 is unable to shift positions axially during operation of ACM 2, thereby ensuring containment ring 54 maintains axial position relative fan blades 20 should a blade out event occur. Guide surface 64, shelf surface 78, and tubular body 84 restrain radial movement and displacement of containment ring 54 during operation of ACM 2. As discussed below, and best represented in FIGS. 2 and 3, guide surface 64, shelf 66, and recess 70 of inner ring 50 can be sized to maintain fit between containment ring 54, shroud 56, and inner ring 50, and to improve the energy-dissipating performance of containment ring 54.

Stop surface 76 can be spaced an axial distance D1 from first end 60 of inner ring 50. Recess 70 can extend an axial distance D2 from first end 60 of inner ring 50. Recess 70 can also include an outer diameter D3 relative center axis 14 of fan and compressor housing 40. Guide surface 64 can have a diameter D4 relative center axis 14 of fan and compressor housing 40. Shelf surface 78 can include a diameter D5 relative center axis 14 of fan and compressor housing 40. In one embodiment, axial distance D1 can be about 4.711 cm (1.855 inches) to about 4.737 cm (1.865) inches in length. In the same embodiment, axial distance D2 can be about 0.220 cm (0.087 inches) to about 0.246 cm (0.097 inches) in length. Outer diameter D3 of recess 70 can be about 16.370 cm (6.445 inches) in length. Diameter D4 of guide surface 64 can be about 15.595 cm (6.140 inches) to about 15.621 cm (6.150 inches) in length, and diameter D5 of shelf surface 78 can be about 14.325 cm (5.640 inches) to about 14.351 cm (5.650 inches) in length. Table 1 is provided below with a list of values for dimensions D1, D2, D3, D4, and D5.

TABLE 1

| | |
|---|---|
| D1 | 4.711 cm-4.737 cm |
| D2 | 0.220 cm-0.246 cm |
| D3 | 16.370 cm-16.370 cm |
| D4 | 15.595 cm-15.621 cm |
| D5 | 14.325 cm-14.351 cm |

To ensure shelf 66 and recess 70 of inner ring 50 are sized to fit containment ring 54 with sufficient length to contain fan blades 20 in a blade out event, a ratio (D1/D2) of the axial distance D1 of stop surface 76 from first end 60 of inner ring 50 to the axial distance D2 that recess 70 extends from first end 60 of inner ring 50 can be approximately 19.227 to approximately 21.322.

The thickness of containment ring 54 must be sufficient to contain impacts from fan blades 20 should a blade out event occur. To provide sufficient radial clearance between guide surface 64 and shelf surface 78 to accommodate the proper thickness of containment ring 54, a ratio (D4/D5) of the diameter D4 of guide surface 64 to the diameter D5 of shelf surface 78 can be approximately 1.088 to approximately 1.089.

A ratio (D2/D3) of axial distance D2 to outer diameter D3 of the recess can be approximately 0.013 to approximately 0.015 to ensure that recess 70 can accommodate flange 86 of containment ring 54 both in the axial direction and the radial direction. Axial distance D2 of recess 70 can also be selected so that flange 86 of containment ring 54 comes into sufficient frictional contact with both inner ring 50 and mounting flange 94 of shroud 56 that containment ring 54 is unable to rotate about center axis 14 during normal operating conditions of ACM 2. While containment ring 54 is unable to rotate about center axis 14 during normal operation conditions of ACM 2, axial distance D2 of recess 70 can also be selected so the frictional resistance between flange 86 of containment ring 54 and mounting flange 94 of shroud 56 and inner ring 50 can be overcome by a fan blade impact in the event of a blade out event. Allowing containment ring 54 to become rotationally dislodged and rotate upon impact in a blade out event aids containment ring 54 in safely dissipating energy from the blade out event. A ratio (D3/D4) of the outer diameter D3 of recess 70 to the diameter D4 of guide surface 64 can be approximately 1.050, thereby providing enough radial clearance to accommodate all of flange 86 of containment ring 54.

Inner ring 50 can include additional dimensional ratios to size guide surface 64, shelf 66, and recess 70 so as to maintain fit between containment ring 54, shroud 56, and inner ring 50. For example, a ratio (D1/D3) of the axial distance D1 of stop surface 76 from first end 60 of inner ring 50 to the outer diameter D3 of recess 70 can be approximately 0.288 to approximately 0.289. A ratio (D1/D4) of the axial distance D1 of stop surface 76 from first end 60 of inner ring 50 to the diameter D4 of guide surface 64 can be approximately 0.302 to approximately 0.303. A ratio (D1/D5) of the axial distance D1 of stop surface 76 from first end 60 of inner ring 50 to the diameter D5 of shelf surface 78 can be approximately 0.329 to approximately 0.330. A ratio (D3/D5) of the outer diameter D3 of recess 70 to the diameter D5 of shelf surface 78 can be approximately 1.142 to approximately 1.143.

Cavity 68 can also be formed in inner ring 50 and can be positioned radially inward from shelf 66 and guide surface 64 to reduce the overall weight of inner ring 50 and ACM 2. Reducing the weight of ACM 2 is beneficial in that a reduction of weight in ACM 2 translates into weight reduction and improved fuel efficiency of an aircraft incorporating ACM 2. Cavity 68 can also aid in the assembling of second end 82 of containment ring 54 onto shelf 66 of inner ring 50 by providing more clearance and space between shelf 66 and the rest of inner ring 50 without increasing the diameter D4 of guide surface 64.

In view of the foregoing description, it will be recognized that the present disclosure provides numerous advantages and benefits. For example, the present disclosure provides ACM 2 with fan and compressor housing 40. Fan and compressor housing includes inner ring 50 with guide surface 64, shelf 66, and recess 70 that allow for removable connection of containment ring 54 and shroud 56. Should a blade out event occur in fan section 4 of ACM 2, containment ring 54 and shroud 56 are configured to absorb the majority of the energy and damage caused by the blade out event, sparing the rest of fan and compressor housing 40 from significant damage. After a blade out event, containment ring 54 and shroud 56 can be removed from inner ring 50 of fan and compressor housing 40 and replaced. Cost savings are obtained because containment ring 54 and shroud 56 are relatively cheap to replace in comparison to the cost of replacing all of compressor housing 40. Furthermore, the present disclosure provides recess 70 which can be sized so that flange 86 of containment ring 54 is in sufficient frictional contact with both inner ring 50 and mounting flange 94 of shroud 56 so that containment ring 54 is unable to rotate about center axis 14 during normal operating conditions of ACM 2. While containment ring 54 is unable to rotate about center axis 14 during normal operation conditions of ACM 2, recess 70 can also be sized so that the frictional resistance between flange 86 of containment ring 54 and mounting flange 94 of shroud 56 and inner ring 50 can be overcome by a fan blade impact in the event of a blade out event. Allowing containment ring 54 to become rotationally dislodged and rotate upon impact in a blade out event aids containment ring 54 in safely dissipating energy from the blade out event.

The following are non-exclusive descriptions of possible embodiments of the present invention.

In one embodiment, a fan housing for an air cycle machine includes an outer ring disposed around a center axis of the fan housing, and at least one strut extending radially inward from the outer ring. An inner ring is disposed radially inward from the outer ring and is connected to the at least one strut opposite the outer ring. The inner ring includes a first end disposed axially opposite a second end and a guide surface facing radially inward relative the center axis and formed between the first end and the second end. The inner ring also includes a shelf disposed radially inward from the guide surface. The shelf includes a stop surface extending radially and disposed axially between the second end and the guide surface. The shelf also includes a shelf surface facing radially outward relative the center axis and extending axially between the first end and the stop surface.

The fan housing of the preceding paragraph can optionally include, additionally and/or alternatively, any one or more of the following features, configurations and/or additional components:

the inner ring further comprising: a recess formed in the first end, wherein the recess extends axially between the first end and the guide surface, and wherein the recess extends radially inward to the guide surface;

the inner ring further comprises: a mounting surface disposed at the first end, wherein the mounting surface extends radially outward from the recess;

the stop surface is spaced an axial distance D1 from the first end, the recess extends an axial distance D2 from the first end, and a ratio of the axial distance D1 to the axial distance D2 is 19.227 to 21.322;

the stop surface is spaced an axial distance D1 from the first end, the recess comprises an outer diameter D3 relative the center axis of the fan housing, and wherein a ratio of the axial distance D1 to the outer diameter D3 of the recess is 0.288 to 0.289;

the stop surface is spaced an axial distance D1 from the first end, the guide surface comprises a diameter D4 relative the center axis of the fan housing, and wherein a ratio of the axial distance D1 to the diameter D4 of the guide surface is 0.302 to 0.303;

the stop surface is spaced an axial distance D1 from the first end, the shelf surface comprises a diameter D5 relative the center axis of the fan housing, and wherein a ratio of the axial distance D1 to the diameter D5 of the shelf surface is 0.329 to 0.330;

the recess extends an axial distance D2 from the first end, the recess comprises an outer diameter D3 relative the center axis of the fan housing, and wherein a ratio of the axial distance D2 to the outer diameter D3 of the recess is 0.013 to 0.015;

the recess comprises an outer diameter D3 relative the center axis of the fan housing, the guide surface comprises a diameter D4 relative the center axis of the fan housing, and wherein a ratio of the outer diameter D3 of the recess to the diameter D4 of the guide surface is approximately 1.050;

the recess comprises an outer diameter D3 relative the center axis of the fan housing, the shelf surface comprises a diameter D5 relative the center axis of the fan housing, and wherein a ratio of the outer diameter D3 of the recess to the diameter D5 of the shelf surface is 1.142 to 1.143; and/or the guide surface comprises a diameter D4 relative the center axis of the fan housing, the shelf surface comprises a diameter D5 relative the center axis of the fan housing, and wherein a ratio of the diameter D4 of the guide surface to the diameter D5 of the shelf surface is 1.088 to 1.089.

In another embodiment, a fan housing for an air cycle machine includes a fan exit flow passage and a ring disposed around a center axis of the fan housing and disposed around the fan exit flow passage. The ring includes a first end disposed axially opposite a second end and a guide surface facing radially inward relative the center axis and formed between the first end and the second end. The ring also includes a shelf disposed radially inward from the guide surface. The shelf includes a stop surface extending radially and disposed axially between the second end and the guide surface. The shelf also includes a shelf surface facing radially outward relative the center axis and extending axially between the first end and the stop surface.

The fan housing of the preceding paragraph can optionally include, additionally and/or alternatively, any one or more of the following features, configurations and/or additional components:

the inner ring further comprising: a recess formed in the first end, wherein the recess extends axially between the first end and the guide surface, and wherein the recess extends radially inward to the guide surface; and a mounting surface disposed at the first end, wherein the mounting surface extends radially outward from the recess;

the fan housing further comprising: a containment ring comprising: a tubular body extending axially between a first end and a second end of the containment ring; a flange extending radially outward from the tubular body at the first end of the containment ring, wherein the second end of the tubular body extends onto the shelf surface of the shelf, and the flange extends into the recess; and/or the fan housing further comprising: a shroud comprising: a tubular body extending between a first end and a second end of the shroud; a mounting flange extending radially outward from the tubular body of the shroud at the first end of the shroud, wherein the second end of the tubular body of the shroud is disposed radially inward from the tubular body of the containment ring and radially inward of the shelf surface, and wherein the mounting flange is disposed against the mounting surface of the ring and covers the recess and the flange of the containment ring.

Any relative terms or terms of degree used herein, such as "substantially", "essentially", "generally", "approximately", and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transitory vibrations and sway movements, temporary alignment or shape variations induced by operational conditions, and the like.

While the invention has been described with reference to an exemplary embodiment(s), it will be understood by those skilled in the art that various changes may be made and equivalents may be substituted for elements thereof without departing from the scope of the invention. For example, while FIG. 1 shows the invention implemented in a four-wheel ACM, the invention can also be used in three-wheel ACMs. In addition, many modifications may be made to adapt a particular situation or material to the teachings of the invention without departing from the essential scope thereof. For example, while FIGS. 1-3 show fan and compressor housing 4 as a single casing for both fan section 4 and compressor section 6, fan and compressor housing 4 can be divided into a fan housing that is a separate component from a compressor housing. Therefore, it is intended that the invention not be limited to the particular embodiment(s) disclosed, but that the invention will include all embodiments falling within the scope of the appended claims.

The invention claimed is:

1. A fan housing for an air cycle machine, the fan housing comprising:

an outer ring disposed around a center axis of the fan housing;

at least one strut extending radially inward from the outer ring; and an inner ring disposed radially inward from the outer ring and connected to the at least one strut opposite the outer ring; wherein the inner ring further comprises:

a first end disposed axially opposite a second end;

a guide surface facing radially inward relative the center axis and formed between the first end and the second end;

a shelf disposed radially inward from the guide surface, wherein the shelf comprises:

a stop surface extending radially and disposed axially between the second end and the guide surface; and a shelf surface facing radially outward relative the center axis and extending axially between the first end and the stop surface; and a recess formed in the first end, wherein the recess extends axially between the first end and the guide surface, and wherein the recess extends radially inward to the guide surface.

2. The fan housing of claim 1, wherein the inner ring further comprises:

a mounting surface disposed at the first end, wherein the mounting surface extends radially outward from the recess.

3. The fan housing of claim 2, wherein the stop surface is spaced an axial distance D1 from the first end, the recess extends an axial distance D2 from the first end, and a ratio of the axial distance D1 to the axial distance D2 is 19.227 to 21.322.

4. The fan housing of claim 2, wherein the stop surface is spaced an axial distance D1 from the first end, the recess comprises an outer diameter D3 relative the center axis of the fan housing, and wherein a ratio of the axial distance D1 to the outer diameter D3 of the recess is 0.288 to 0.289.

5. The fan housing of claim 2, wherein the stop surface is spaced an axial distance D1 from the first end, the guide surface comprises a diameter D4 relative the center axis of the fan housing, and wherein a ratio of the axial distance D1 to the diameter D4 of the guide surface is 0.302 to 0.303.

6. The fan housing of claim 2, wherein the stop surface is spaced an axial distance D1 from the first end, the shelf surface comprises a diameter D5 relative the center axis of the fan housing, and wherein a ratio of the axial distance D1 to the diameter D5 of the shelf surface is 0.329 to 0.330.

7. The fan housing of claim 2, wherein the recess extends an axial distance D2 from the first end, the recess comprises an outer diameter D3 relative the center axis of the fan housing, and wherein a ratio of the axial distance D2 to the outer diameter D3 of the recess is 0.013 to 0.015.

8. The fan housing of claim 2, wherein the recess comprises an outer diameter D3 relative the center axis of the fan housing, the guide surface comprises a diameter D4 relative the center axis of the fan housing, and wherein a ratio of the outer diameter D3 of the recess to the diameter D4 of the guide surface is approximately 1.050.

9. The fan housing of claim 2, wherein the recess comprises an outer diameter D3 relative the center axis of the fan housing, the shelf surface comprises a diameter D5 relative the center axis of the fan housing, and wherein a ratio of the outer diameter D3 of the recess to the diameter D5 of the shelf surface is 1.142 to 1.143.

10. The fan housing of claim 2, wherein the guide surface comprises a diameter D4 relative the center axis of the fan housing, the shelf surface comprises a diameter D5 relative the center axis of the fan housing, and wherein a ratio of the diameter D4 of the guide surface to the diameter D5 of the shelf surface is 1.088 to 1.089.

11. A fan housing for an air cycle machine, the fan housing comprising:

a fan exit flow passage; and a ring disposed around a center axis of the fan housing and disposed around the fan exit flow passage; wherein the ring comprises:

a first end disposed axially opposite a second end;

a guide surface facing radially inward relative the center axis and formed between the first end and the second end;

a shelf disposed radially inward from the guide surface, wherein the shelf comprises:

a stop surface extending radially and disposed axially between the second end and the guide surface; and a shelf surface facing radially outward relative the center axis and extending axially between the first end and the stop surface;

a recess formed in the first end, wherein the recess extends axially between the first end and the guide surface, and wherein the recess extends radially inward to the guide surface; and a mounting surface disposed at the first end, wherein the mounting surface extends radially outward from the recess.

12. The fan housing of claim 11, wherein the fan housing further comprising:

a containment ring comprising:

a tubular body extending axially between a first end and a second end of the containment ring;

a flange extending radially outward from the tubular body at the first end of the containment ring, wherein the second end of the tubular body extends onto the shelf surface of the shelf, and the flange extends into the recess.

13. The fan housing of claim 12, wherein the fan housing further comprising:

a shroud comprising:

a tubular body extending between a first end and a second end of the shroud;

a mounting flange extending radially outward from the tubular body of the shroud at the first end of the shroud, wherein the second end of the tubular body of the shroud is disposed radially inward from the tubular body of the containment ring and radially inward of the shelf surface, and wherein the mounting flange is disposed against the mounting surface of the ring and covers the recess and the flange of the containment ring.

* * * * *